US012674460B2

(12) United States Patent
Camatti et al.

(10) Patent No.: US 12,674,460 B2
(45) Date of Patent: Jul. 7, 2026

(54) CENTRIFUGAL COMPRESSOR WITH ENERGY RECOVERY FROM A RECYCLE LINE

(71) Applicant: NUOVO PIGNONE TECNOLOGIE - S.R.L., Florence (IT)

(72) Inventors: Massimo Camatti, Florence (IT); Manuele Bigi, Florence (IT)

(73) Assignee: NUOVO PIGNONE TECNOLOGIE—S.R.L., Florence (IT)

( * ) Notice: Subject to any disclaimer, the term of this patent is extended or adjusted under 35 U.S.C. 154(b) by 0 days.

(21) Appl. No.: 18/730,976

(22) PCT Filed: Jan. 23, 2023

(86) PCT No.: PCT/EP2023/025032
§ 371 (c)(1),
(2) Date: Jul. 22, 2024

(87) PCT Pub. No.: WO2023/143867
PCT Pub. Date: Aug. 3, 2023

(65) Prior Publication Data

US 2025/0101987 A1 Mar. 27, 2025

(30) Foreign Application Priority Data

Jan. 28, 2022 (IT) ..... 102022000001415

(51) Int. Cl.
*F04D 17/12* (2006.01)
*F04D 27/00* (2006.01)
(Continued)

(52) U.S. Cl.
CPC ..... *F04D 17/122* (2013.01); *F04D 17/12* (2013.01); *F04D 27/001* (2013.01); *F04D 27/02* (2013.01);
(Continued)

(58) Field of Classification Search
CPC ..... F04D 17/122; F04D 27/001; F04D 27/02; F04D 27/0253; F04D 25/024
See application file for complete search history.

(56) References Cited

U.S. PATENT DOCUMENTS 1,110,864 A * 9/1914 Banner ..... F04D 17/122 417/323
3,105,632 A * 10/1963 Tanzberger ..... F04D 29/0513 415/199.1
(Continued)

FOREIGN PATENT DOCUMENTS

EP 3569866 A1 11/2019

*Primary Examiner* — Courtney D Heinle
*Assistant Examiner* — Cameron A Corday
(74) *Attorney, Agent, or Firm* — CANTOR COLBURN LLP

(57) ABSTRACT

A centrifugal compressor is described comprising an anti-surge return line is disclosed, wherein a radial expan-sion impeller is arranged downstream the compressor discharge and one or more flow regulators are arranged between the compressor discharge and the radial expansion impeller, and wherein the radial expansion impeller discharge is con-nected with the anti-surge return line. A method for control-ling surge in a compressor is also described, the method comprising a step of directing at least a portion or volume of the continuous flow of fluid from the compressor to a radial expansion impeller and to a return line.

14 Claims, 3 Drawing Sheets

(51) Int. Cl.

| | |
|---|---|
| ***F04D 27/02*** | (2006.01) |
| ***F04D 29/051*** | (2006.01) |
| ***F04D 29/28*** | (2006.01) |
| ***F04D 29/44*** | (2006.01) |

(52) U.S. Cl.
CPC ..... *F04D 27/023* (2013.01); *F04D 27/0253* (2013.01); *F04D 29/051* (2013.01); *F04D 29/284* (2013.01); *F04D 29/441* (2013.01)

(56) References Cited

U.S. PATENT DOCUMENTS

| | | | | |
|---|---|---|---|---|
| 3,826,594 | A * | 7/1974 | Hornschuch | F04D 25/024 417/409 |
| 4,067,665 | A * | 1/1978 | Schwartzman | F04D 13/04 415/209.1 |
| 9,133,850 | B2 * | 9/2015 | Narayanan | F04D 27/001 |
| 2010/0272588 | A1 * | 10/2010 | Scotti Del Greco | F02C 1/005 417/408 |
| 2017/0002822 | A1 * | 1/2017 | Brenne | F04D 27/0207 |
| 2018/0135637 | A1 * | 5/2018 | Narayanan | F04D 27/0223 |
| 2025/0180032 | A1 | 6/2025 | Camatti et al. | |

* cited by examiner

CENTRIFUGAL COMPRESSOR WITH ENERGY RECOVERY FROM A RECYCLE LINE

TECHNICAL FIELD

The present disclosure concerns centrifugal compressors and in particular centrifugal compressors with an anti-surge control system. More in particular, the present disclosure concerns centrifugal compressors with a recycle line returning a portion of the discharge gas from the outlet to the inlet of the compressor and means for recovering energy from said portion of the discharge gas. Embodiments disclosed herein specifically concern centrifugal compressors comprising a recycle line and means for energy recovery arranged along said recycle line, together with suitable instrumentation for monitoring and control.

BACKGROUND ART

Centrifugal and axial compressors can experience a potentially destructive condition known as surge.

Surge is defined as the operating point at which centrifugal compressor peak head capability and minimum flow limits are reached. This condition occurs when the amount of gas handled by a compressor is insufficient for the size of the compressor and the blades lose their ability to transfer energy from the shaft to the fluid.

The working principle of a centrifugal compressor is causing a pressure rise by adding kinetic energy/velocity to a continuous flow of fluid through a rotor and subsequently converting this kinetic energy to an increase in potential energy/static pressure by slowing the flow through a diffuser. The pressure rise in the rotor is in most cases almost equal to the rise in the diffuser. The fluid flow from the diffuser is then gathered by a collector and delivered downstream at a required pressure and flow rate.

It is known that, during startup/emergency shutdown, when the fluid flow through a compressor is greatly reduced, surge can occur and the compressor can become unable to match the downstream flow needs. The pressure of the collector can be higher than the compressor outlet pressure and the fluid tends to reverse or even flow back in the compressor. As a consequence, the collector pressure decreases, inlet pressure increases and the flow reverses again. This phenomenon repeats and occurs in cycles with frequencies varying from 1 to 2 Hz. The compressor loses the ability to maintain the peak head and the entire system becomes unstable.

Surging can cause the compressor to overheat to the point at which the maximum allowable temperature of the unit is exceeded. Also, surging can cause damage to the thrust bearing of the rotor due to the rotor shifting back and forth from the active to the inactive side. This is defined as the surge cycle of the compressor.

In order to avoid surge, anti-surge control systems are normally made available together with compressors, to detect when a process compression stage is approaching to surge and subsequently take action to maintain stable working conditions by decreasing the collector pressure and increasing the flow through the compressor. Making reference to FIG. 1, showing a schematic of a centrifugal compressor including an anti-surge control systems according to the prior art, this is normally achieved by providing a compressor 1, with a recycle line 2 (also called anti-surge line), the recycle line 2 returning a portion of the discharge gas from the outlet 3 to the inlet 4 of the compressor 1. An anti-surge control system 5 is connected to temperature, pressure and flow measuring instruments 6 on an outlet line 7 of the compressor 1 and to temperature, pressure and flow measuring instruments 8 on an inlet line 9 of the compressor 1. Operation of such an anti-surge control system 5 is performed by opening a control valve 10 (also called anti-surge valve) in the recycle line 2, through a valve control subsystem 10'. As a result of the returning of a portion of the discharge gas of the compressor to the inlet 4 of the compressor 1, the minimum required flow rate is always guaranteed at the compressor inlet 4. The gas flow returned to the compressor 1 is normally passed through a scrubber 11, which is arranged upstream of the inlet 4 of the compressor 1. The scrubber 11 is normally needed in order to prevent liquid from entering the compressor 1. The gas flow returned to the compressor 1 is also passed through a cooling system 12 (chiller), which can be arranged upstream or downstream the anti-surge valve 10 and which sometimes can also be by-passed, depending on the dynamics that need to be granted. FIG. 1 also shows a driver 13 of the compressor and a cooling system 14 of the portion of the gas flow that is not returned to the compressor 1, but routed to downstream services 15 or process. The driver 13 drives the compressor 1 in rotation by providing the required mechanical power. The driver 13 can be an electric motor. In other embodiments the driver 13 can be a mechanical power-generating turbomachine, such as a gas turbine engine or a steam turbine. In yet further embodiments, the driver 13 can include a reciprocating, internal combustion engine.

As a result of the use of an anti-surge control system, the operating condition of the compressor is maintained stable as there is a dual effect of increasing the flow rate and reducing the delivery pressure having actually changed the resistance curve of the system.

Moreover, in some applications, the anti-surge line can also be used to extend the operating range of the compressor towards low flow rates. Therefore, the antisurge system can operate either during shutdown and startup, or during normal operation.

As far as the effects of surging to the thrust bearing of the compressor is concerned, the following must also be considered.

A centrifugal compressor processes a certain volume of gas to increase its pressure. In particular, in a multistage compressor there is an incremental increase in pressure stage by stage. As a consequence, in normal operation the pressure downstream the compressor is higher than upstream and a resulting effect of the compressor operation is the generation of an axial force on the rotor. In addition to the differential pressure, the axial force is essentially due also to the contribution from variation of momentum in the various parts of the rotor.

Making reference to FIG. 2, a schematic of a longitudinal section of a centrifugal compressor according to the prior art is shown. In FIG. 2 the same reference numbers designate the same or corresponding parts, elements or components already illustrated in FIG. 1 and described above, and which will not be described again. In particular, FIG. 2 shows a section of a half of a compressor 1, above an axis z of rotation of a rotor 16. FIG. 2 also shows a stator 17, the compressor's gas flow inlet 4 and outlet 3. The axial force on the rotor 16 is counteracted by a thrust bearing 18. In order to minimize the size of the thrust bearing 18, the architecture of the compressor includes an axial thrust balancing system that reduces its magnitude. The balancing system consists of a balancing drum 19, which is mounted on the rotor 16 and interfaces with a stator seal 20, arranged downstream the compressor discharge. Since a pressure drop occurs at the interface between the balancing drum 19 and the stator seal 20, in normal operation the balancing drum 19 counteracts a higher pressure upstream (normally the discharge pressure of the compressor 1) and a lower pressure downstream (normally the suction pressure of the compressor 1). The pressure difference across the front surface of the balancing drum 19 generates a force that balances the other thrust contributions and which can be modulated by the choice of the diameter of the balancing drum 19. The fluid exiting the balancing drum 19 is directed through a pipe to the source of low pressure, which is normally the compressor suction, but can be any other lower pressure point inside or outside the machine.

Accordingly, improved anti-surge control systems to address the issues of instability and risk of damage to the thrust bearing of the compressors of the current art would be beneficial and would be welcomed in the technology. More in general, it would be desirable to provide systems adapted to more efficiently address problems entailed by surging.

SUMMARY

In one aspect, the subject matter disclosed herein is directed to a centrifugal compressor wherein a radial expansion impeller is arranged on the rotor shaft end downstream the compressor discharge, the discharge of said radial expansion impeller being connected with a recycle line, returning a portion of the compressor discharge gas to the inlet of the compressor.

In another aspect, the subject matter disclosed herein concerns an arrangement of a centrifugal compressor with a radial expander connected through gas passage and mechanical device, where the expander can perform pressure expansion of the operating fluid and produce useful mechanical power.

BRIEF DESCRIPTION OF THE DRAWINGS

A more complete appreciation of the disclosed embodiments of the invention and many of the attendant advantages thereof will be readily obtained as the same becomes better understood by reference to the following detailed description when considered in connection with the accompanying drawings, wherein.

DETAILED DESCRIPTION OF EMBODIMENTS

Figure 1:
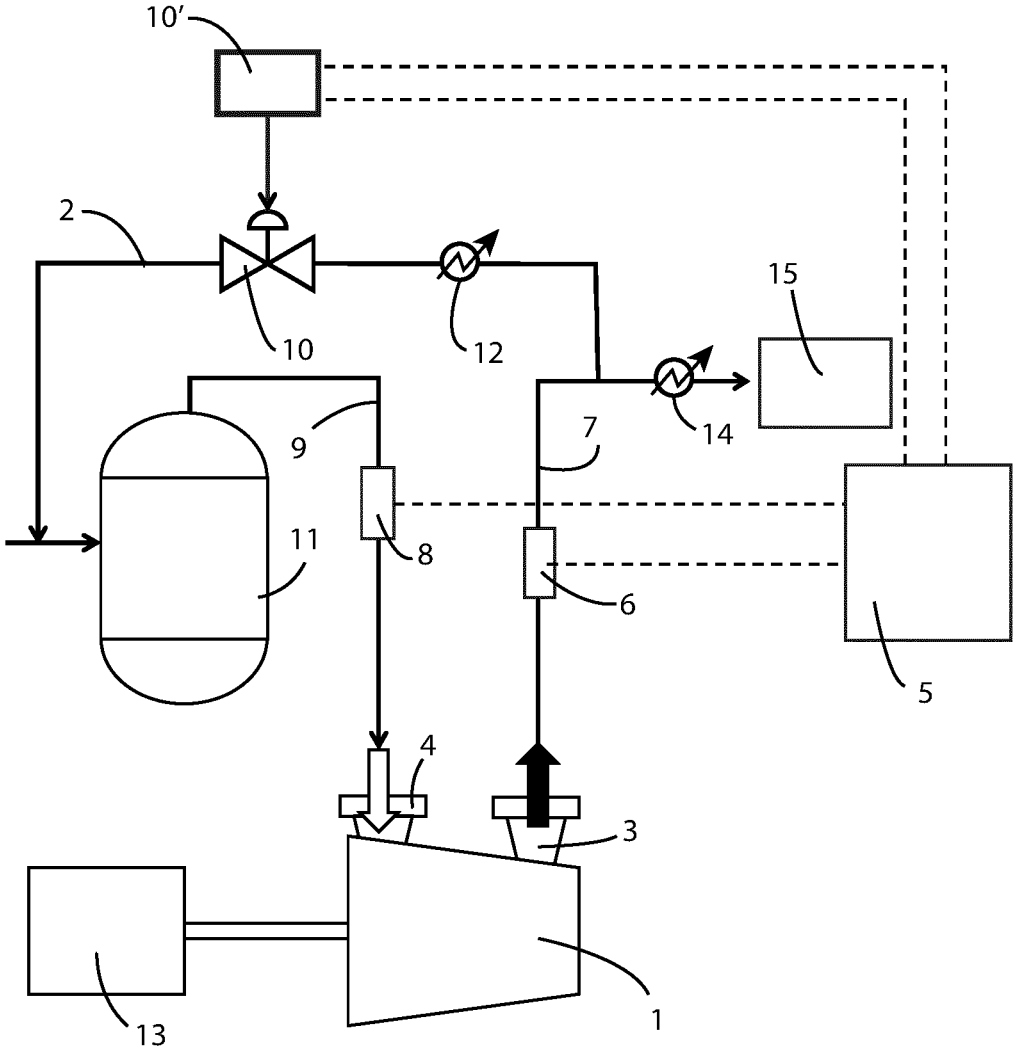
Fig. 1 (Prior art)
FIG. 1 illustrates a schematic of a centrifugal compressor including an antisurge control system according to the prior art.

According to one aspect, the present subject matter is directed to a centrifugal compressor wherein a centrifugal expansion impeller is arranged downstream the compressor discharge, to transform potential energy/static pressure of the discharge gas from the compressor into kinetic energy and balance the axial thrust of the compressor.

According to another aspect, the discharge of said radial expansion impeller is connected with a recycle line, returning a portion of the discharge gas of the compressor to the inlet of the compressor, acting as an anti-surge system.

According to one aspect, the present subject matter involves a radial compressor wherein a radial expansion impeller replaces the balancing drum of the centrifugal compressors of the prior art.

According to another aspect, a nozzle system is configured to regulate the passage of gas through the expansion impeller allowing partial or total passage of the discharge flow of the compressor.

According to yet another aspect, a diffuser is configured to convey the gas processed by the radial expansion impeller downstream to a discharge volute, connected to a return line routed to the compressor suction.

According to a further aspect, the diffuser is alternatively directed axially or radially.

According to another aspect, the radial expansion impeller is positioned along the rotor, for example overhung outward the journal bearing. In particular, this arrangement is convenient for configurations where fluid can be released to atmosphere.

According to still another aspect, the machine is equipped with gas journal bearing or active magnetic bearing.

Reference now will be made in detail to embodiments of the disclosure, one or more examples of which are illustrated in the drawings. Each example is provided by way of explanation of the disclosure, not limitation of the disclosure. In fact, it will be apparent to those skilled in the art that various modifications and variations can be made in the present disclosure without departing from the scope or spirit of the disclosure. Reference throughout the specification to "one embodiment" or "an embodiment" or "some embodiments" means that the particular feature, structure or characteristic described in connection with an embodiment is included in at least one embodiment of the subject matter disclosed. Thus, the appearance of the phrase "in one embodiment" or "in an embodiment" or "in some embodiments" in various places throughout the specification is not necessarily referring to the same embodiment(s). Further, the particular features, structures or characteristics may be combined in any suitable manner in one or more embodiments.

When introducing elements of various embodiments the articles "a", "an", "the", and "said" are intended to mean that there are one or more of the elements. The terms "comprising", "including", and "having" are intended to be inclusive and mean that there may be additional elements other than the listed elements.

Figure 2:
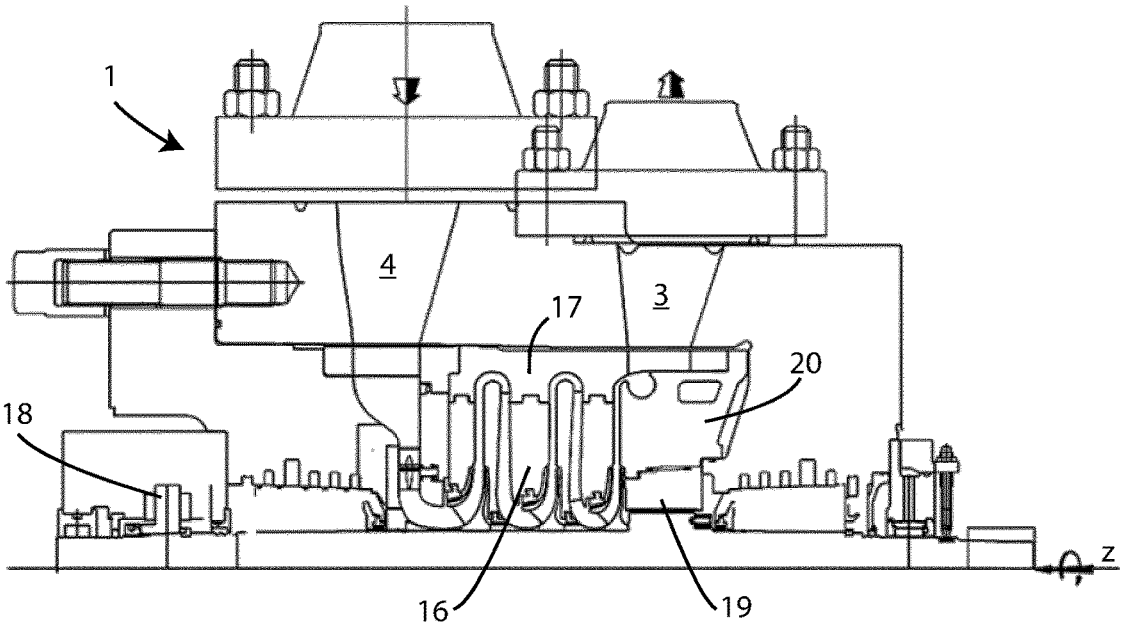
Fig. 2 (Prior art)
FIG. 2 illustrates a schematic of a longitudinal section of a centrifugal compressor including a balancing drum according to the prior art.
Figure 3:
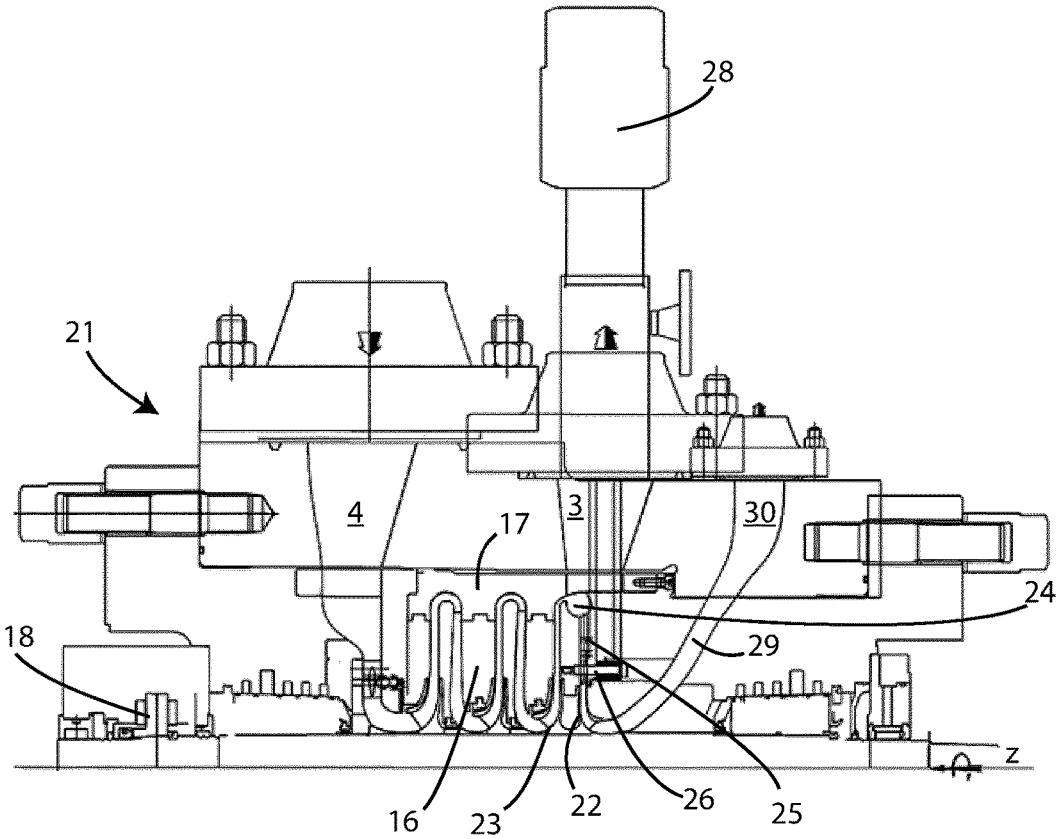
FIG. 3 illustrates a schematic of a longitudinal section of a centrifugal compressor including a radial expansion impeller and a discharge gas recycle line, according to an embodiment.

Referring now to the drawings, in particular to FIG. 3, a schematic of a longitudinal section of a centrifugal compressor according to an embodiment is illustrated, wherein the same reference numbers designate the same or corresponding parts, elements or components already illustrated in FIG. 1 and/or FIG. 2 and described above, and which will not be described again. In particular, FIG. 3 shows a section of a half of a compressor 21, above an axis z of rotation of a rotor 16. FIG. 3 also shows the stator 17 and the thrust bearing 18, and the compressor's gas flow inlet 4 and outlet 3.

A radial expansion impeller 22 is arranged downstream the compressor discharge 23, to receive the gas flow directly from the compressor discharge volute 24 through a deswirler 25. The passage of the gas flow through the expansion impeller 22 is regulated by a system including one or more adjustable nozzles 26 configured to regulate the amount of gas flow passing through the radial expansion impeller 22. Accordingly, the one or more nozzles 26 can be regulated to allow 100% of the gas flow (i.e. the total gas flow) to pass through the impeller 22, or any amount less than 100% of the total gas flow (i.e. a partial amount or volume of the total gas flow) to pass through the impeller 22. The one or more nozzles 26 may also control the flow rate of the gas flow, and in some embodiments where multiple nozzles 26 are used, the amount of gas flow through each nozzle and/or the associated gas flow rate through each nozzle may be the same for all nozzles 26 or may differ between any of the nozzles. When only a partial gas flow is allowed through the impeller 22, the remaining amount, portion or volume of the gas flow—i.e. the gas flow not passing through the expansion impeller 22—is delivered toward the downstream service or process 15 (as example a pipeline, a tank, a chemical reactor, a cavern, a reservoir, heat exchanger etc) at the compressor design delivery pressure.

Figure 4:
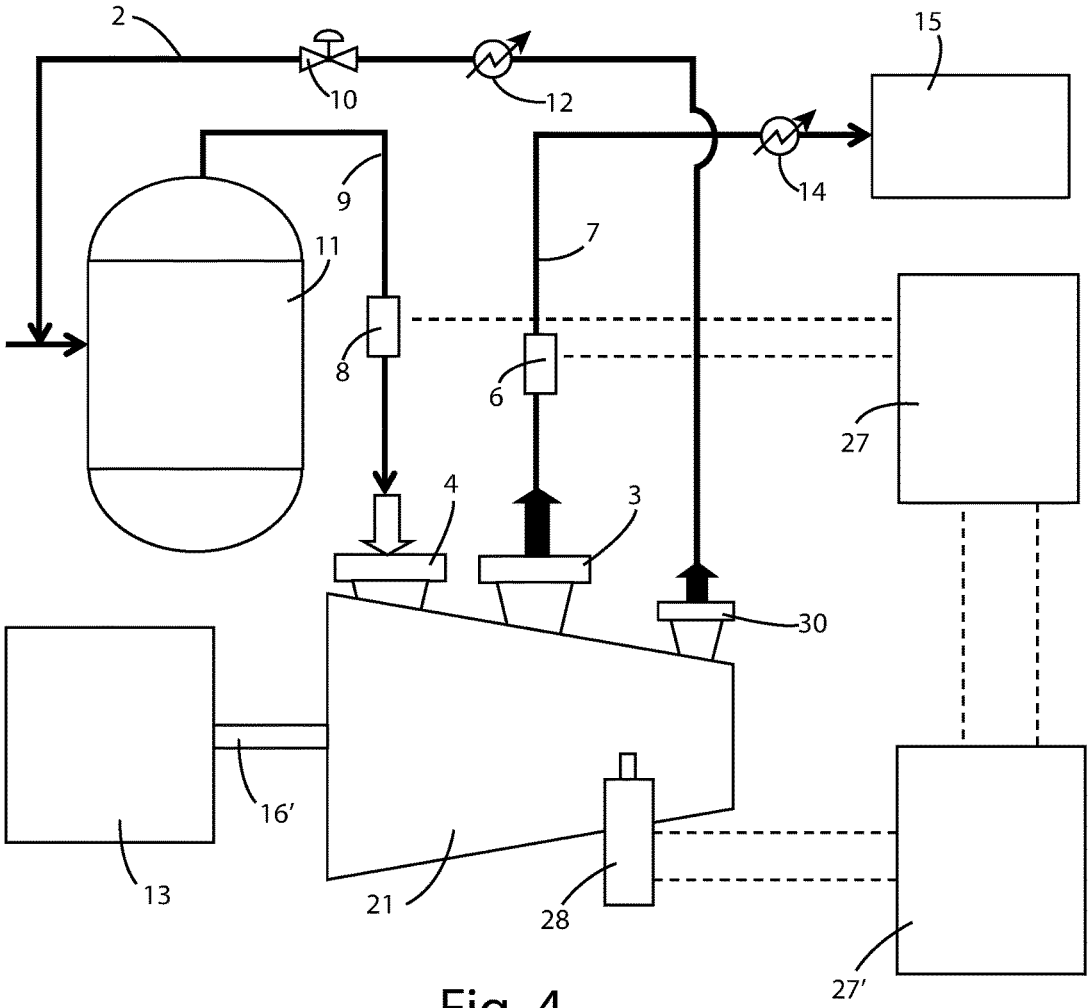
FIG. 4 illustrates a schematic of a centrifugal compressor including an antisurge control system according to the disclosure.

Making reference also to FIG. 4, showing a schematic of a centrifugal compressor including an anti-surge control system according to an embodiment, the adjustable nozzles 26 are automatically controlled to keep the operating point within the compressor stable operating map (as discussed herein below, with reference to FIG. 5), by an antisurge control system 27, connected to temperature, pressure and flow measuring instruments 6 on an outlet line 7 of the compressor 21 and to temperature, pressure and flow measuring instruments 8 on an inlet line 9 of the compressor 21 and to a nozzle guide vane control subsystem 27', which is in turn connected to a nozzle guide vane actuator 28, to adjust the nozzles 26 of the expansion impeller 22 as needed.

The discharge 29 of the radial expansion impeller 22 is connected to a diffuser 30 and subsequently, through a recycle line 2, to the inlet 4 of the compressor 21.

The centrifugal compressor including an anti-surge control system according to the disclosure shall reduce the reaction time of the system providing a more effective control, since the location of the input signal (compressor discharge measure) is the same of the control actuation (compressor discharge and recycle inlet are in the same place), removing the delay due to the gas volume (piping and devices) between the compressor discharge and anti-surge control valve of the prior art.

Figure 5:
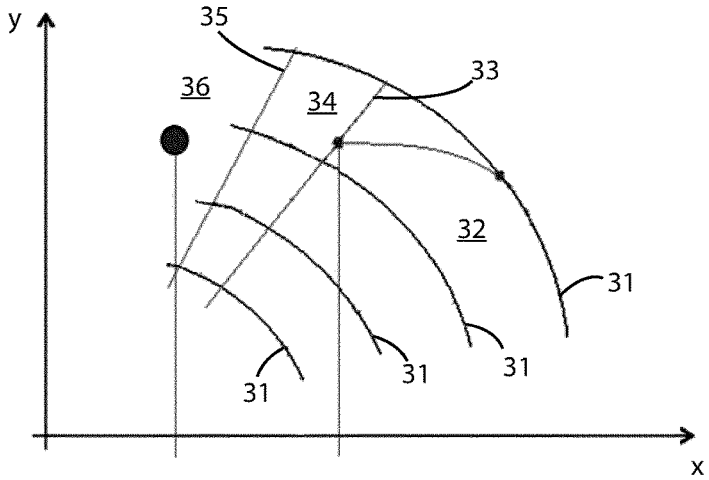
FIG. 5 illustrates a compressor operating map.

Making also reference to FIG. 5, showing a compressor operating map, that is a map showing the operating conditions of the compressor as a point representing the head y of the compressor, i.e. the ratio discharge pressure/suction pressure, as a function of the inlet flow x, the centrifugal compressor 21 of the disclosure operates as follows. The compressor operating map shows some curves 31, specific for any compressor for different rotational speeds, and is divided into three regions: a stable operation region 32, on the right of a surge control line 33, a margin region 34, comprised among the surge control line 33 and a surge limit line 35, and an unstable operation region 36, on the left of the surge limit line 35. During normal operation, i.e. when the operating point is in the stable operation region 32 of the compressor operating map, the gas flow ($G_{cc}$) processed by the compressor 21 is divided into a flow ($G_{out}$) at the compressor outlet 3 and a flow ($G_{exp}$) to the expansion impeller 22.

$$G_{cc} = G_{out} + G_{exp}$$

During normal operation, the flow rate at the compressor outlet 3 is much higher than the flow rate processed by the expansion impeller 22: $G_{out} >> G_{exp}$ (e.g. 96% and 4% of $G_{cc}$ respectively).

If the antisurge control system 27, by continuously monitoring the compressor inlet flow x and relative delivered head y, detects that the process compression stage is approaching a surge condition or state, for example when the operating point 37 is on the surge control line 32, then the antisurge control system 27 will communicate to the nozzle control subsystem 27' to operate the nozzle actuator 28 and subsequently open the adjustable nozzles 26, causing a greater portion or volume of the total gas flow from the compressor discharge 23, via the deswirler 25, to pass through the expansion impeller 22, transforming the potential energy/static pressure of the expansion impeller 22 into kinetic energy.

During this phase, the flow rate processed by the expansion impeller 22 may vary from a small portion (minimum recycle) to the entire compressor flow (full recycle) (e.g. 0% and 100% of $G_{cc}$ respectively).

The energy $E_{rec}$ recovered by the expansion impeller 22 is proportional to the capacity $G_{exp}$ of the expansion impeller 22 and its efficiency $\eta_{exp}$:

$$E_{rec} \equiv G_{exp} * \eta_{exp}$$

Notably, assuming that the efficiency of the expansion impeller 22 is 0.8 and 10% of the process flow is recycled to the inlet of the compressor 21, power wasted with a conventional anti-surge valve would be 10% of the total compression power, while in comparison, the power loss due to the expansion impeller 22 is advantageously only 2% of the total compression power.

Additionally, since the gas flow pressure downstream of the expansion impeller 22 is lowered to the value of the pressure at the compressor inlet 4, the expansion impeller 22 will effectively eliminate pressure differences between the pressure downstream and upstream the rotor 16 and any resulting axial force on the rotor 16.

The gas processed by the radial expansion impeller 22 is then conveyed through the diffuser 30 and is finally returned to the compressor inlet 4, through the return line 2.

As an advantageous consequence, the radial expansion impeller 22 effectively performs the dual function of balancing the axial thrust of the compressor and recovering the energy from the processed flow.

The power produced by the radial expansion impeller 22 contributes to drive the operating machines, thus reducing the absorbed power from the main driver 13, or the power output required by the main driver 13, during normal operation.

The antisurge control system can open the nozzle 20 either during normal operation or during equipment shut down. In the first case the power produced by the radial expansion impeller 22 is used either to help the driver 13 or to charge a battery system. In case of antisurge opening during trip or shutdown, the power produced by the radial expansion impeller 22 may be not used to contribute to drive the compressor, since it is no longer required, rather can be stored by batteries for further use.

It should be noted that the arrangements illustrated in FIGS. 3 and 4 can be variously combined to one another.

While aspects of the invention have been described in terms of various specific embodiments, it will be apparent to those of ordinary skill in the art that many modifications, changes, and omissions are possible without departing form the spirt and scope of the claims. In addition, unless specified otherwise herein, the order or sequence of any process or method steps may be varied or re-sequenced according to alternative embodiments.

The invention claimed is:

1. A centrifugal compressor comprising:

a compressor rotor;

a compressor stator;

a working fluid compressor inlet;

a working fluid compressor outlet and a driver, the driver driving the compressor rotor in rotation through a rotor shaft end, wherein a radial expansion impeller is arranged on the rotor shaft end downstream of the compressor rotor, the radial expansion impeller comprising a radial expansion impeller inlet and a radial expansion impeller discharge, and multiple adjustable nozzles are arranged about the compressor between the working fluid compressor discharge and the radial expansion impeller inlet to regulate an amount of the working fluid allowed to pass through the radial expansion impeller, and wherein the radial expansion impeller discharge is connected with the working fluid compressor inlet through a return line; and an antisurge control system in communication with temperature, pressure and flow measuring instruments on an outlet line of the compressor and to temperature, pressure and flow measuring instruments on an inlet line of the compressor and with the multiple nozzles, the antisurge control system configured to adjust the multiple nozzles to increase and/or decrease the amount of the working fluid allowed to pass through the radial expansion impeller.

2. The centrifugal compressor of claim 1, wherein a compressor discharge volute is arranged downstream of the working fluid compressor discharge and a deswirler is arranged between the compressor discharge volute and the radial expansion impeller inlet.

3. The centrifugal compressor of claim 1, wherein a diffuser is arranged between the radial expansion impeller discharge and the return line.

4. The centrifugal compressor of claim 1, wherein a nozzle guide vane actuator is configured to actuate the multiple adjustable nozzles and operate the compressor in recycling mode.

5. A method for controlling surge in a compressor, the compressor causing a pressure rise to a continuous flow of a working fluid; the method comprising:

providing a radial expansion impeller downstream a compressor discharge;

providing multiple adjustable nozzles between the compressor discharge and the radial expansion impeller;

providing a return line downstream the radial expansion impeller to connect it with the compressor;

wherein the method further comprises adjusting the multiple adjustable nozzles to direct at least a portion or volume of the continuous flow of fluid to pass through the radial expansion impeller and to the return line.

6. The method of claim 5, wherein the multiple adjustable nozzles is adjusted to direct 100% of the continuous gas flow through the radial expansion impeller and to the return line.

7. The method of claim 5, wherein the multiple adjustable nozzles is adjusted to direct less than 100% of the continuous gas flow through the radial expansion impeller and to the return line.

8. The method of claim 7, wherein an amount of the continuous gas flow not directed through the radial expansion impeller is delivered to a down-stream service or process at the compressor design delivery pressure.

9. The method of claim 5, further comprising the step of passing the continuous gas flow through a deswirler before the continuous gas flow is directed through the radial expansion impeller.

10. The centrifugal compressor of claim 1, further comprising a nozzle guide vane actuator connected to at least one of the multiple adjustable nozzles.

11. The centrifugal compressor of claim 1, further comprising a nozzle guide vane control subsystem.

12. The centrifugal compressor of claim 1, wherein one or more of the multiple adjustable nozzles include different flow rates.

13. The centrifugal compressor of claim 1, wherein the multiple adjustable nozzles are automatically controlled to keep the operating point of the compressor within a stable operating map.

14. The centrifugal compressor of claim 5, wherein the adjusting includes:

communicating from an antisurge control system to a nozzle control subsystem operably connected to the multiple adjustable nozzles.

* * * * *